US006644774B1

(12) United States Patent
Burger et al.

(10) Patent No.: US 6,644,774 B1
(45) Date of Patent: Nov. 11, 2003

(54) INK JET PRINTHEAD HAVING OUT-OF-INK DETECTION USING TEMPERATURE MONITORING SYSTEM

(75) Inventors: William R. Burger, Fairport, NY (US); James E. Hogle, Williamson, NY (US); William L. Gary, Rutherfordton, NC (US); Michael Carlotta, Alpharetta, GA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/226,662

(22) Filed: Aug. 22, 2002

(51) Int. Cl.[7] ..... B41J 29/393; B41J 29/38
(52) U.S. Cl. ..... 347/19; 347/17
(58) Field of Search ..... 347/5, 7, 9, 14, 347/17, 18, 19, 23

(56) References Cited

U.S. PATENT DOCUMENTS

| | | | | | |
|---|---|---|---|---|---|
| 4,532,530 | A | | 7/1985 | Hawkins | 347/62 |
| 4,638,337 | A | | 1/1987 | Torpey et al. | 347/65 |
| 4,719,472 | A | | 1/1988 | Arakawa | 347/67 |
| 4,774,530 | A | | 9/1988 | Hawkins | 347/63 |
| 4,791,435 | A | | 12/1988 | Smith et al. | 347/14 |
| 4,994,826 | A | | 2/1991 | Tellier | 347/65 |
| 5,036,337 | A | | 7/1991 | Rezanka | 347/14 |
| 5,107,276 | A | | 4/1992 | Kneezel et al. | 347/60 |
| 5,477,246 | A | * | 12/1995 | Hirabayashi et al. | 347/19 |
| 5,665,249 | A | | 9/1997 | Burke et al. | 216/2 |
| 5,710,579 | A | * | 1/1998 | Hahs et al. | 347/7 |
| 6,234,599 | B1 | * | 5/2001 | Ishinaga et al. | 347/14 |

* cited by examiner

*Primary Examiner*—Juanita Stephens
(74) *Attorney, Agent, or Firm*—Robert Chittum

(57) ABSTRACT

A thermal ink jet printhead for a printer has a temperature sensor attached thereto for monitoring the operating temperature thereof. A maximum printhead operating temperature is stored in a memory of the printer's control circuitry and, if the printhead temperature sensed by the temperature sensor during a printing operation exceeds the maximum operating temperature stored is the memory, a signal is generated indicating that the printhead has stopped ejecting ink droplets and must be checked for depriming or a depleted ink supply.

5 Claims, 4 Drawing Sheets

INK JET PRINTHEAD HAVING OUT-OF-INK DETECTION USING TEMPERATURE MONITORING SYSTEM

BACKGROUND OF THE INVENTION

The present invention relates to printheads for thermal ink jet printers, and, more particularly, to thermal ink jet printheads that have a temperature monitoring system that is used to determine when the printhead has deprimed or its ink supply has been depleted.

Thermal ink jet printing systems use thermal energy pulses generated by the heating elements in an ink jet printhead to produce momentary ink vapor bubbles on the heating elements which eject ink droplets from the printhead nozzles. One type of such a printhead has a plurality of parallel ink channels, each communicating at one end with an ink reservoir and having opposing open ends that serve as nozzles in the droplet emitting face of the printhead. A heating element, usually a resistor, is located in each of the ink channels a predetermined distance upstream from the nozzles. The heating elements are individually driven with a current pulse to momentarily vaporize the ink and form a bubble that expels a droplet of ink. The channel is then refilled by capillary action, drawing ink from a supply tank. A meniscus is formed at each nozzle under a slight negative pressure to prevent ink from weeping therefrom. Operation of a thermal ink jet printer is described, for example, in U.S. Pat. No. 4,849,774 and U.S. Pat. No. 4,571,599.

The carriage type ink jet printer typically has one or more small printheads containing the ink channels and nozzles in a nozzle face. The printheads are connected to an ink supply tank. In one configuration, the printhead and one or more ink tanks are integrally assembled and the entire configuration, sometimes referred to as a cartridge, is disposable when the ink in the ink tanks are depleted. In another configuration, the printhead is an integral part of a replaceable ink tank support and replaceable ink supply tanks are installed on the ink tank support. Generally, the ink tank support is first installed on the printer's translatable carriage and then the ink supply tanks are installed. Each of the ink supply tanks is replaced when the ink contained therein is depleted. The replaceable ink tank support should not need to be replaced until at least ten ink supply tanks have been emptied during printing operations.

For carriage type multicolor ink jet printers of the latter type, there is a replaceable ink tank support for printing black ink and a separate replaceable ink tank support for printing non-black inks. These ink tank supports are installed on the printer's carriage and then the respective ink tanks are installed on the appropriate ink tank support. Whether the carriage type ink jet printer uses replaceable cartridges comprising integral printheads and ink supply tanks or replaceable ink tank supports with integral printheads and separate replaceable ink tanks, both types are translated back and forth in the printing zone of the printer to print a swath of information on a recording medium, such as paper. The swath height is equal to the length of the column of nozzles in the printhead's nozzle face. The paper is held stationary during the printing and, after the swath is printed, the paper is stepped a distance equal to the height of the printed swath or a portion thereof. This procedure is repeated until the entire page is printed or until all information has been printed, if less than a page. For an example of a typical ink cartridge, refer to U.S. Pat. No. 5,519,425 which discloses disposable ink cartridges having integral printheads and ink supply tanks, and refer to U.S. Pat. No. 5,971,531 for a replaceable ink tank support having integral printheads and separately replaceable ink supply tanks.

As is well known, thermal ink jet printheads heat up during a printing operation. If the printhead heats up too high during, for example, extended high density printing, the printhead may loose prime or become deprimed. When the printhead becomes deprimed, one or more nozzles of the printhead cease to expel ink droplets. To safe guard against excessive heating of the printhead, many prior printheads incorporate a heat sink of sufficient thermal mass and of low enough thermal resistance that the printhead temperature does not rise excessively and does not exceed the maximum operating temperature of the printhead. For one example of a printhead having a heat sink, refer to U.S. Pat. No. 4,831,390. Nevertheless, this approach does not eliminate the catastrophic printing failure mode, if printing is attempted during a printhead deprime wherein the ink in the channels retract from the nozzles and from the heating elements. In this event, the application of electrical current pulses to the heating elements without ink in contact with them causes a rapid rise in temperature of the heating elements and thus the printhead. If the printing operation is not discontinued within a relatively short time period, the printhead will be damaged or destroyed. The same problem is encountered when the ink supply to the printhead is depleted. It is especially important to stop the printing of an unattended ink jet printer when the printhead becomes deprimed or the ink supply is depleted, for continued attempted printing beyond a brief period of time will severely damage a printhead.

It is known that increase in temperature of the printhead above its normal operating temperature affects the printing quality. The printed droplet size or pixel size varies with temperature. In fact, the mass and velocity of the ejected droplet increase with printhead temperature and contribute to the increased pixel size on the paper or other recording medium.

In many existing thermal ink jet printers, various techniques are employed to maintain the printhead operating temperature within the appropriate range. For example, as disclosed in U.S. Pat. No. 4,791,435, the printing speed of the printer is slowed if the temperature of the printhead begins to rise too high. In another example, U.S. Pat. No. 5,107,276 discloses the selective energization of heating elements in the printhead not being used to print with energy pulses insufficient in magnitude to vaporize ink in order to prevent printhead temperature fluctuations during a printing operation. U.S. Pat. No. 5,036,337 discloses the varying of the energizing pulses to the heating elements to control the droplet volume. U.S. Pat. No. 4,719,472 discloses the use of a separate heater and temperature sensor to heat and monitor the temperature of the ink in the reservoir to adjust the viscosity of the ink.

Though it is known to monitor and control the operating temperature of thermal ink jet printheads to maintain print quality, there is a problem of cost effectively identifying a deprime of the printhead or an empty ink supply container. This is especially a problem when the printer is being operated at a remote location or for an unattended operation, where a user cannot see that the printhead has stopped ejecting ink droplets. The known methods of detecting the presence or absence of ejected ink droplets from printheads during a printing operation are generally complex and expensive, while the aim of this invention is to determine such event in a simple cost effective manner.

SUMMARY OF THE INVENTION

It is an object of the present invention to provide an ink jet printhead having means to detect absence of droplet ejection during a printing operation by utilizing information from the printhead temperature monitoring system.

In one aspect of the present invention, there is provided a thermal ink jet printhead for an ink jet printer having means to determine when the printhead has stopped ejecting ink droplets during a printing operation, comprising: a structure having an ink supplying reservoir with an ink inlet thereto, a plurality of droplet ejecting nozzles, and a plurality of capillarily filled ink flow directing channels that interconnect the reservoir to each of the nozzles; a plurality of selectively addressable heating elements, one heating element being located in each channel a predetermined distance upstream from the nozzles, the heating elements producing momentary ink vapor bubbles when energized to eject ink droplets; a temperature sensor for sensing the temperature of said structure; and a control circuit for selectively applying electrical signals to the heating elements for energization thereof in response to image data signals received thereby, the control circuit including a memory for the storage of a predetermined temperature indicative of the maximum allowable operating temperature of the structure, means for comparing the sensed temperature of said structure with said predetermined temperature stored in said memory and generating a signal whenever said sensed temperature is greater than the predetermined stored in said memory, whereby a signal generated by said means for comparing and generating in said control circuit is indicative of a stoppage of droplet ejection by said structure during a printing operation.

BRIEF DESCRIPTION OF THE DRAWINGS

The present invention will now be described, by way of example, with reference to the accompanying drawings, in which like reference numerals refer to like elements, and in which.

DESCRIPTION OF THE PREFERRED EMBODIMENT

Figure 1:
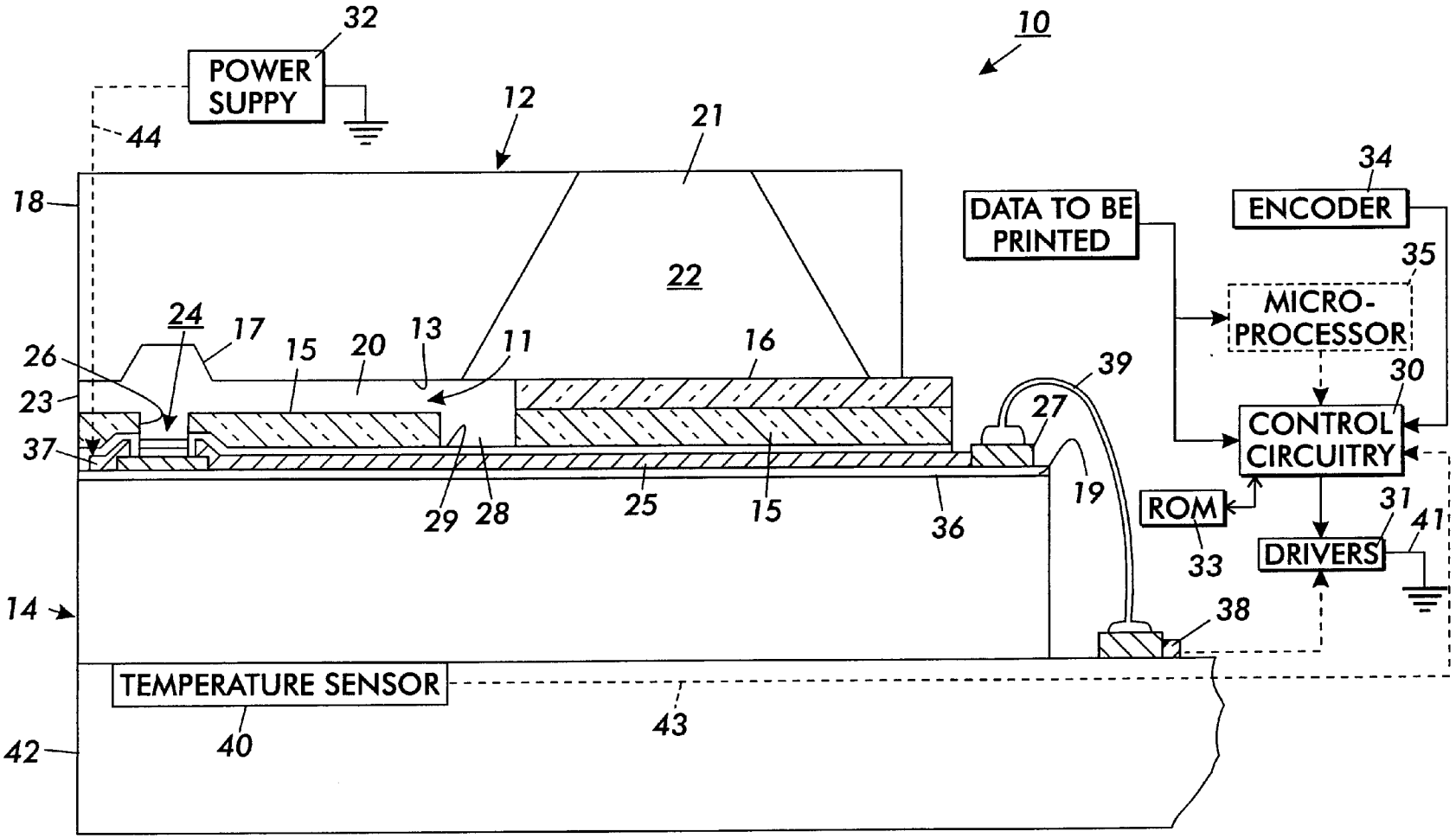
FIG. 1 is a cross sectional view of an ink jet printhead with the control circuitry of the present invention.

Typical carriage-type thermal ink jet printers have a printhead that traverses back and forth across a recording medium and ink droplets are ejected from nozzles in the printhead on to the recording medium. The droplets are ejected on demand in response to electrical signals from the printer's control circuitry. In FIG. 1, a cross sectional view is shown of a thermal ink jet printhead 10 of the present invention, as viewed through one of the ink channels 20. This view thus shows the ink flow path from ink inlet 21 through the reservoir 22 and ink channel 20 to the printhead nozzle 23 in nozzle face 18 as depicted by arrow 11. The printhead comprises an upper substrate or channel plate 12 and lower substrate or heater plate 14 with at least two separately deposited and patterned layers 15,16 of polymeric material sandwiched therebetween.

The heater plate 14 has a linear array of multi-layered heating elements 24 and addressing electrodes 25 patterned on the surface 19 thereof. The heating elements 24 of the printhead 10 are similar to those disclosed in U.S. Pat. No. 4,532,530 and U.S. Pat. No. 4,638,337, the relevant parts of which are incorporated herein by reference. The channel plate 12 has etched in surface 13 thereof an array of relatively small recesses 17 and a through hole 22 that serves as the reservoir. In the preferred embodiment, the channel plate is a portion of a silicon (100) wafer (not shown) having the orientation dependent etched recesses 11 and through hole 22 etched from surface 13 thereof. The through hole 22 serves as the printhead ink reservoir and the open bottom 21 thereof serves as the ink inlet. Each of the small recesses 17 is to be subsequently aligned directly over a respective one of the heating elements 24 and is used for bubble expansion during the printing process. The heater plate 14 Is also a portion of another silicon (100) wafer, and has a linear array of heating elements 24 formed on one surface 19 thereof, together with addressing electrodes 25. As discussed later, polymeric layer 15 is deposited on an underglaze layer 36 on surface 19 of the heater plate 14 and over the heating elements and addressing electrodes. The polymeric layer 15 is then patterned to remove the polymeric layer 15 from each heating element, thus placing each heating element in pits 26. The use of a polymeric layer, sometimes referred to as a thick film layer, to place heating elements in pits is well known, such as disclosed in U.S. Pat. No. 4,774,530, the relevant parts of which are incorporated herein by reference. In addition to forming the pits 26 to expose the heating elements, the contact pads 27 for the addressing electrodes are cleared of the polymeric layer and an elongated recess 28 is formed. Next, polymeric layer 16 is deposited over the patterned polymeric layer 15 and the heating elements 24, contact pads 27, and elongated recess 28 exposed through polymeric layer 15 Polymeric layer 16 is patterned to form a plurality of parallel channels 20, one for each heating element 24, and to remove polymeric layer 16 from the heating elements, elongated recess 28, and the contact pads 27.

Though the heater plate 14 may be an electrically insulative material, such as, for example, glass or a ceramic material, the heater plate is preferably a portion of a silicon wafer (not shown). Forming a plurality of sets of polysilicon heating elements and associated addressing electrodes for each set of heating elements on the polished surface of a silicon wafer are well known in the ink jet industry, as disclosed in U.S. Pat. No. 4,994,826 and U.S. Pat. No. 4,532,530, and will, therefore, not be discussed in detail.

The ink droplets (not shown) are ejected from nozzles 23 by control circuitry 30, drivers 31, and power supply 32 in response to receipt of data to be printed. An encoder 34 monitors when the printhead is in the printing zone of an ink jet printer (not shown). The control circuitry has a memory 33, such as, for example, a ROM, for storing at least one predetermined temperature, as discussed later, or the memory may be part of an optional microprocessor 35, shown in dashed line.

As well known in the industry, a plurality of sets of bubble generating heating elements 24 and their addressing electrodes 25 are patterned on the surface of an underglaze layer 36, such as silicon dioxide, that has been coated on a polished surface of a (100) silicon wafer (not shown). As the mass production of ink jet printheads from aligned and bonded channel wafers and heater wafers that are severed into a plurality of individual printheads are well known, subsequent discussion of the printhead of this invention will be in terms of the individual printhead. The addressing electrodes include a common return electrode 37 and both terminate with contact pads 27. The addressing electrodes 25 and common return 37 are typically aluminum leads deposited on the underglaze layer 36 and over the edges of the heating elements 24. A, passivation layer 29 is deposited on the addressing electrodes and underglaze layer 36 covering surface 19 of the heater plate. The passivation layer 29 is pattered to remove the passivation layer from the heating elements 24 and contact pads 27. The contact pads are located at locations to on the heater plate 14 to allow clearance for wire bonding, after the channel plate 12 is attached to make the printhead 10. The contact pads 27 are connected to electrodes 38 by wire bonds 39, and electrodes 38 are electrically connected to the drivers 31.

A polymeric layer 15, such as polyimide or SU-8®, is deposited on the passivation layer 29 and over the linear arrays of exposed heating elements and contact pads. The portion of a silicon wafer containing one linear array of heating elements and associated addressing electrodes is the heater plate 14. As mentioned above, the invention will hereafter be discussed in terms of the heater plate 14 rather than in terms of a wafer that contains many lower substrates or heater plates. Polymeric layer 15 is patterned by means well known in the industry to remove the polymeric layer 15 from each of the heating elements and contact pads and to form an elongated recess 28 which exposes the passivation layer 29 on the heater plate.

Though the printhead 10 of this invention is described with only two polymeric layers 15,16 for sake of clarity, N layers of polymeric material could be used with N being at least two.

Polymeric layer 16 is then deposited over the patterned polymeric layer 15 and exposed heating elements, elongated recess 28, and contact pads 27. Polymeric layer 16 is patterned to remove the polymeric layer 16 from the contact pads and elongated recess 27, and concurrently to form a parallel set of channel recesses 20 having opposing ends. The channel recesses are substantially perpendicular to the elongated recess 28. One channel recess is provided for each heating element 24, and each channel recess is aligned with and contains therein a respective one of the heating elements in pit 26. One end of the channel recesses opens into the elongated recess 28, while the other channel recess ends are open through printhead face 18 and will subsequently serve as the nozzles 23.

The top surface of polymeric layer 16 is polished by a chemical/mechanical process to produce a flat surface which can be bonded to the channel plate 12 without gaps. A typical chemical/mechanical polishing processes is described in U.S. Pat. No. 5,665,249 and is incorporated herein by reference. In some cases, it may be desired to polish both polymeric layers 15,16, so that the surface of the first polymeric layer 15 is smooth and flat in front of the heating elements and adjacent the nozzles.

A temperature sensor 40 is attached to the surface of the heater plate 14 opposite to the one containing the heating elements and addressing electrodes and prior to mounting the printhead 10 on a ceramic coated, metallic substrate that serves as a heat sink 42. The ceramic-coated heat sink contains the electrodes 38 which connect to the drivers 31. The printhead 10 may be bonded to the ceramic coated heat sink with a suitable adhesive. The thickness of the temperature sensor 40 is about 1 to 10 $\mu$m, so that it will hot interfere with the attachment of the printhead to the heat sink 42. The temperature sensor may be optionally located on the same surface of the heater plate that contains the heating elements and addressing electrodes or on the opposite side of the heat sink from which the printhead is attached. The temperature sensor lead 43 (shown in dashed line) may be a dedicated electrode mounted on either side of the heat sink 42. The temperature signals from sensor 40 are directed to the control circuitry 30 via lead 43 (shown in dashed line). In response to digitized image data signals directed to the control circuitry 30, the control circuitry enables the energization of selected heating elements through associated drivers 31, after signals from the encoder 34 are received through lines 45 indicating that the printhead is in the printing zone of the printer (not shown). The heating elements 24 are connected to a power supply 32 via line 44 (shown in dashed line) and common return electrode 37. The drivers are connected to the heating elements via addressing electrodes 25, wire bonds 39, and electrodes 38 on the heat sink. The drivers are connected to ground through line 41.

In this embodiment of the invention, the power supply 32 provides a constant voltage to the common return electrode 37. The heating elements 24 are pulsed with this voltage through drivers 31 that are connected to the printhead addressing electrodes 25 and to ground. Thus, the electrical pulses applied to the heating elements have a constant amplitude. Using standard procedure, the normal frequency of applying the electrical pulses to the heating elements may be reduced, if the temperature sensed by the temperature sensor exceeds a predetermined value stored in the control circuitry memory 33, thereby reducing the energy input to the printhead, so that the printhead temperature may be maintained within the desired operating range.

Figure 2:
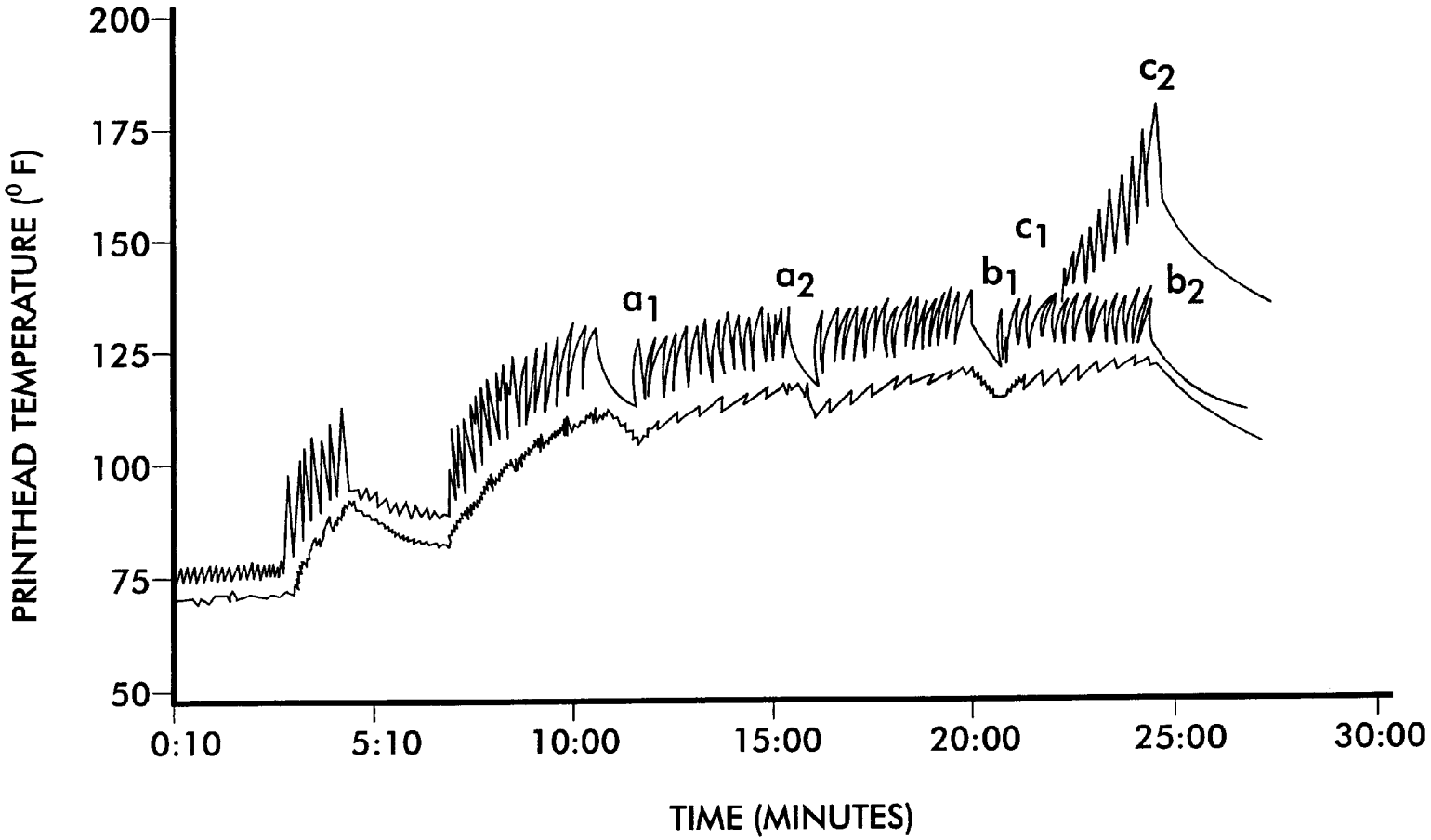
FIG. 2 is a plot of the printhead temperature versus printing time during successive half tone printing and showing the temperature curve when the printhead fails to eject droplets during a printing operation.

Referring to FIG. 2, a printhead temperature profile for successive half tone printing by printhead 10 is plotted as temperature in degrees F versus printing time in minutes. Once the printhead begins printing, the temperature thereof increases from its ambient temperature of about 75° F. to the normal operating temperature range of between 100° F. and 125° F. A typical half tone temperature printing plot is depicted by the portion of the curve indicated by $a_1$–$a_2$, and a normal temperature profile of the printhead during a printing operation is depicted by the portion of the curve indicated by $b_1$–$b_2$. However, if the ink recedes from the heating elements, as occurs if air is ingested and the printhead is deprimed or if the ink supply is depleted, then the printhead temperature rises rapidly above the normal temperature operating as indicated by the portion of the curve indicated by $c_1$–$c_2$, where the printhead temperature rises above the normal operating temperature range by 40–60° F. Some heat is carried away by the ejected ink droplets, and when an energized heating element does not eject an ink droplet, the printhead temperature immediately begins to rise. Using this phenomenon, the control circuitry stops the printing operation and moves the printhead to the printer's maintenance station (not shown) where the printhead is primed to remove any ingested air. Once the printhead has been primed, the printhead is moved to the printing zone and the printing operation continued. If, after a priming operation, the printhead temperature sensed by the temperature sensor is again above the maximum operating temperature, the printing operation is stopped until a new ink supply cartridge is installed.

Thus, by monitoring the temperature of the printhead, the point at which the printhead deprimes or the ink supply runs out of ink can be detected. When the temperature is above a predetermined maximum operating temperature, a signal is given to stop the printing operation. At the first signal responsive to the sensed printhead temperature being above the maximum operating temperature, the printhead is primed at the maintenance station in case it had become deprimed by air ingestion. When printing is resumed and immediately another signal responsive to a sensed printhead temperature being above the maximum operating temperature is generated, further printing is prevented until the ink supply is replaced. If the temperature of the printhead continues to rise above the maximum operating temperature after a priming operation on the printhead, it is clear that the ink supply has been depleted.

Figure 3:
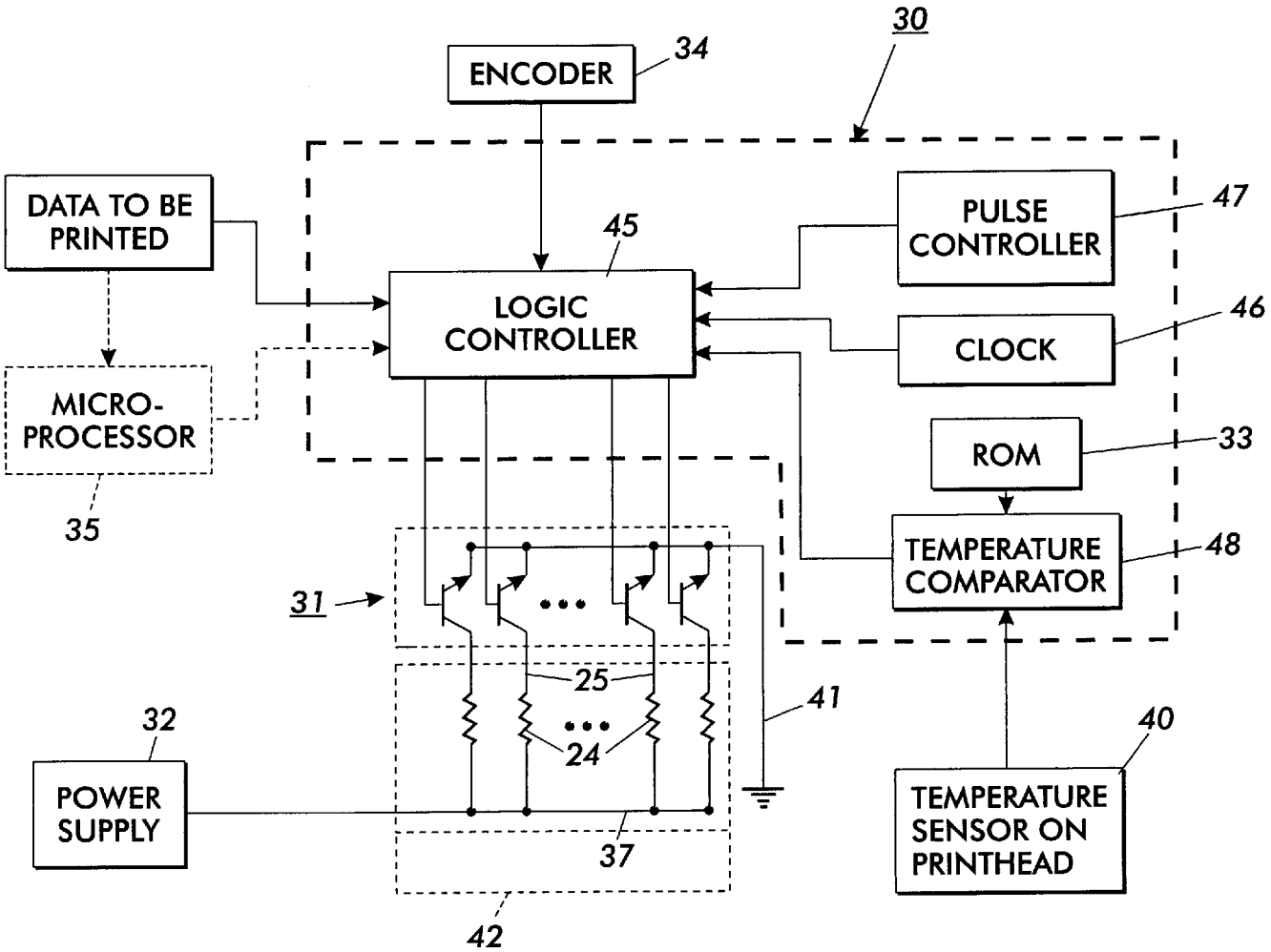
FIG. 3 is a schematic diagram of the control circuitry of FIG. 1.

Referring to FIG. 3, the control circuitry 30 includes a logic controller 45, clock 46, ROM 33, and a temperature comparator 48. The logic controller receives the data to be printed in the form of digitized data signals, or if a microprocessor is optionally used, the data to be printed is sent to the microprocessor and from the microprocessor to the logic controller 45. The encoder 34 provides signals to the logic controller indicative of the location of the printhead 10 relative to the printing zone. The memory or ROM has the maximum operating temperature stored therein, which is about 125° F. in the preferred embodiment. The temperature sensor 40 senses the printhead temperature continually during a printing operation or optionally it may sense the printhead temperature on a periodic basis. The sensed printhead temperature is directed to a comparator 48 where the sensed temperature is compared to a stored predetermined maximum operating temperature in the ROM 33. An overheating signal is sent to the logic controller 45 from the comparator 48, if the sensed temperature is greater than the stored maximum operating temperature. The heating elements of the printhead are energized by an electrical signal having a pulse width given by the pulse controller to the logic controller. The clock 46 provides the timing for the logic controller, and the logic controller selectively energizes or applies the electrical signals to the heating elements at a predetermined frequency, which in the preferred embodiment is about 3 to 4 Khz.

The firing or energizing frequency of the heating elements by the logic controller is reduced to prevent printhead overheating when a threshold temperature, which is also stored in the ROM, is matched by the comparator with the sensed printhead temperature and a threshold signal is sent to the logic controller. The threshold temperature is always less than the maximum operating temperature. Preventing the printhead from overheating reduces the probability of air being ingested during a printing operation. Power supply 32 provides a constant voltage to the common return electrode 37. The heating elements 24 (only four shown) are pulsed with this voltage through drivers 31 selectively activated by the logic controller 45. The drivers 31 are connected to the heating elements 24 though addressing electrodes 25 and to ground via lead 41. Thus, the electrical pulses applied to the heating elements 24 have a constant amplitude to eject an ink droplet from the printhead, but the firing frequency may be varied in response to a rising printhead temperature to prevent air ingestion and lower print quality.

Figure 4:
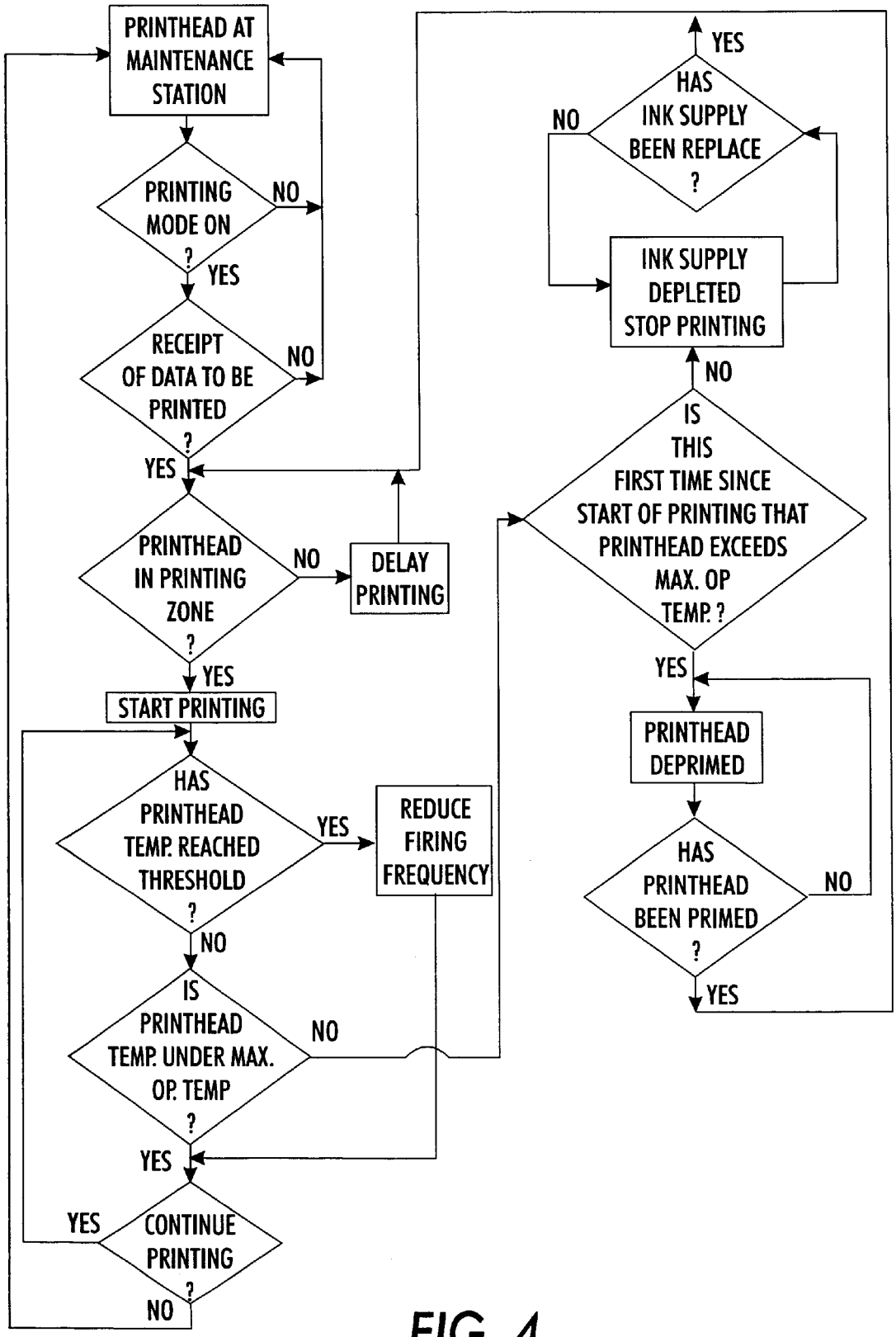
FIG. 4 is a flow chart of the decisions made by the control circuitry in determining a printhead deprime or a depleted ink supply.

Decisions made by the logic controller in FIG. 3 to determine whether the printhead firing frequency should be reduced or the printhead has deprimed or the ink supply has been depleted is shown in FIG. 4. The printhead 10 is capped at the printer's maintenance station (not shown) when not printing. Once the printing mode is activated, the ink channels 20 of the printhead 10 are primed and the heating elements 24 are all pulsed with electrical pulses to eject ink droplets and clear the printhead nozzles 23 of any dried ink therein, in accordance with standard well known operating procedures. The ejected ink droplets are collected in a collection recess or absorbent material, which form part of t,he maintenance station (not shown).

Upon receipt of digitized data to be printed, the printhead is moved from the maintenance station to the printing location in the printer and the location of the printhead is checked to see if it has arrived in the printing zone. If not, printing is delayed until the printhead is within the printing zone. Once the printhead is in the printing zone, ink droplets are ejected and propelled to a recording medium, such as paper (not shown). The logic controller checks to see if a threshold signal or an overheating signal has been received from the comparator. The threshold signal indicates that the printhead temperature has reached a predetermined threshold temperature stored in the ROM 33, which is less than the maximum operating temperature. When the logic controller receives the threshold signal from the comparator, the firing frequency of the heating elements is reduced to slow down the printing by the printhead in order to lessen the heat generated and the printing operation is continued without interruption. Until the logic controller receives the overheating signal from the comparator, indicating that the printhead temperature has exceeded the maximum operating temperature, the printhead continues to print the data received. However, the logic controller continues to check for signals from the comparator. Once the data to be printed has been printed, the printing operation ceases and the printhead is returned to the maintenance station.

When an overheating signal is received from the comparator indicating that the sensed printhead temperature exceeds the maximum operating temperature stored in the ROM, the logic controller checks to see if this is the first indication of overheating since the start of printing of the currently received data. If it is the first time the overheating signal has been received, then the logic controller assumes the printhead has become deprimed and moves the printhead to the maintenance station for a priming procedure. After the printhead has been primed, it is again moved to the printing zone. When the printhead has been verified to be in the printing zone, printing by the printhead is continued, but the printhead temperature is continually monitored. If a second overheating signal is received by the logic controller from the comparator, immediately after the printhead has been primed, the logic controller checks to see if this is the first time the printhead has overheated since beginning the printing of the currently received data to be printed. If it is not the first indication of printhead overheating, the logic controller assumes that the ink supply has been depleted and stops the printing operation and returns the printhead to the maintenance station. The printing operation will not be permitted to start again until the depleted ink supply has been replaced or a manual override (not shown) is actuated by a user indicating the ink supply is not depleted and the printhead merely deprimed again.

Although the foregoing description illustrates the preferred embodiment, other variations are possible and all such variations as will be apparent to those skilled in the art are intended to be included within the scope of this invention as defined by the following claims.

What is claimed is:

1. A thermal ink jet printhead and print control system for an ink jet printer having means to detect an out-of-ink condition during a printing operation by monitoring the printhead temperature, comprising:

a structure having an ink supplying reservoir with an ink inlet thereto for receiving ink from an ink supply, a plurality of droplet ejecting nozzles, and a plurality of capillarily filled ink flow directing channels that interconnect the reservoir to each of the nozzles;

a plurality of selectively addressable heating elements, one heating element being located in each channel, the heating elements producing momentary ink vapor bubbles when energized to eject ink droplets;

a temperature sensor for sensing the temperature of said structure;

a control circuit for selectively applying electrical signals to the heating elements for energization thereof in response to image data signals received thereby, the control circuit including a memory for the storage of a predetermined temperature indicative of the maximum allowable operating temperature of the structure, means for comparing the sensed temperature of said structure by said sensor with said predetermined temperature stored in said memory and generating an overheating signal whenever said sensed temperature is greater than the predetermined temperature stored in said memory;

said control circuit, in response to a first overheating signal generated by said means for comparing and generating and after the beginning of a printing operation, being programmed to assume the printhead has become deprimed and causes said printhead to be primed before the printing operation can be continued; and said control circuit, in response to a second overheating signal generated by said means for comparing and generating and immediately after the printhead has been primed in response to a first overheating signal, being programmed to assume a depleted ink supply and a continued printing operation is prevented until said depleted ink supply is replaced.

2. The printhead as claimed in claim 1, wherein the control circuit further includes a logic controller and a clock; wherein said means for comparing and generating an overheating signal is a temperature comparator; and wherein the logic controller receives said overheating signal.

3. The printhead as claimed in claim 1, wherein the control circuit selectively applies electrical signals to said heating elements at a predetermined frequency; wherein a predetermined threshold temperature is stored in said memory, the threshold temperature being less than the maximum operating temperature; wherein said means for comparing the sensed temperature of said structure with the threshold temperature generates a threshold signal whenever said sensed printhead temperature is equal to the threshold temperature stored in said memory; and wherein said control circuit upon receipt of said threshold signal reduces the frequency of applying electrical signals to the heating elements, in order to slow the printing operation and to reduce the rate of heat generation by said printhead during a printing operation.

4. A thermal ink jet printing system for an ink jet printer having means to detect a depleted ink supply during a printing operation by monitoring the temperature of printing system, comprising:

a printhead having an ink reservoir with an ink inlet for receiving ink from an ink supply, a plurality of droplet ejecting nozzles, a plurality of capillarily filled ink channels that interconnect the reservoir to each of the nozzles, and a plurality of selectively addressable heating elements, one heating element being located in each channel;

a temperature sensor for sensing the temperature of said printhead;

a control circuitry including a logic controller, a memory, and a temperature comparator, said logic controller selectively addressing the heating elements with droplet ejecting electrical pulses in response to receipt of data to be printed, said memory having a maximum operating temperature stored therein, said temperature comparator comparing the temperature of the printhead sensed by said temperature sensor with said maximum operating temperature stored In said memory and generating an overheating signal when said sensed printhead temperature is greater than said stored maximum operating temperature, said overheating signals being directed to said logic controller; and said logic controller interrupting the printing operation and causing said printhead to be primed upon receipt of a first overheating signal prior to continuing the printing operation, and said logic controller interrupting the printing operation and preventing a continued printing operation upon receipt of a second overheating signal immediately after the printhead has been primed, said second overheating signal immediately after the printhead has been primed being indicative of an out-of-ink condition and the continued printing operation being prevented until the depleted ink supply has been replaced.

5. The printing system as claimed in claim 4, wherein a printer user may actuate a manual override to continue a printing operation instead of replacing the ink supply after a second overheating signal is directed to the logic controller.

* * * * *